US008083211B2

(12) United States Patent
Marks et al.

(10) Patent No.: US 8,083,211 B2
(45) Date of Patent: Dec. 27, 2011

(54) STAPLE REMOVER

(75) Inventors: Joel S. Marks, Sherman Oaks, CA (US); Brian E. Melgaard, Boonton, NJ (US)

(73) Assignee: WorkTools, Inc., Chatsworth, CA (US)

( * ) Notice: Subject to any disclaimer, the term of this patent is extended or adjusted under 35 U.S.C. 154(b) by 436 days.

(21) Appl. No.: 12/428,217

(22) Filed: Apr. 22, 2009

(65) Prior Publication Data

US 2009/0267034 A1 Oct. 29, 2009

Related U.S. Application Data

(60) Provisional application No. 61/047,823, filed on Apr. 25, 2008.

(51) Int. Cl.
*B25C 11/00* (2006.01)

(52) U.S. Cl. ..... 254/28

(58) Field of Classification Search ..... 254/28, 254/21, 24; 172/23; 7/160
See application file for complete search history.

(56) References Cited

U.S. PATENT DOCUMENTS

| | | | | | |
|---|---|---|---|---|---|
| 129,412 | A | | 7/1872 | Jackson | |
| 270,085 | A | | 1/1883 | Lewis | |
| 2,202,984 | A | | 6/1940 | Drypolcher | |
| 2,492,246 | A | * | 12/1949 | Von Cseh | 254/28 |
| 2,539,171 | A | | 1/1951 | Yerkes | |
| 2,549,260 | A | | 4/1951 | Sudbury | |
| 2,592,570 | A | | 4/1952 | Hofstetter | |
| 2,638,313 | A | * | 5/1953 | Marano | 254/28 |
| 2,662,727 | A | | 12/1953 | Yerkes | |
| 2,762,604 | A | * | 9/1956 | Misson | 254/28 |
| 2,776,109 | A | | 1/1957 | Segal | |
| 2,940,727 | A | | 6/1960 | Segal | |
| 2006/0102688 | A1 | | 5/2006 | Marks | |

OTHER PUBLICATIONS

International Search Report dated Jun. 17, 2009, pp. 1-2.

* cited by examiner

*Primary Examiner* — David B Thomas
(74) *Attorney, Agent, or Firm* — Paul Y. Feng; The Eclipse Group LLP

(57) ABSTRACT

A staple remover device having first and second opposed, elongated jaws extending from a lower end of the remover toward an upper end of the remover. The jaws are pivoted to the remover at the upper end. With the remover in a substantially perpendicular orientation above a horizontal work surface, the first jaw moves toward the second jaw, actuated by a user's finger pressure. A handle extends along the remover device, the handle being normally operationally fixed to a jaw by a link including a latch, and at a pre-determined position of the first jaw to the second jaw, a release rib of at least one jaw causes the latch to suddenly de-link the handle from the jaw, wherein the de-linked handle moves in relation to the jaw and moving the handle in relation to the jaw causes the other jaw to rise, lifting out the staple.

18 Claims, 3 Drawing Sheets

Start STEP 1

Fig. 4 End STEP 2

End STEP 3

STAPLE REMOVER

CROSS-REFERENCE TO RELATED APPLICATIONS

This is a non-provisional application from which priority is based on provisional application No. 61/047,823, filed Apr. 25, 2008, whose entire contents are hereby incorporated by reference.

BACKGROUND

The present invention relates to staple removers. More precisely, the present invention relates to a reduced effort, cam action, one hand actuated staple remover.

Staples are used to fasten items together. For example, a piece of paper or like sheet material may be attached to a wood or cork substrate with a staple gun or other tacker device. Or a stack of papers may be fastened together with a desktop stapler or similar office appliance. When used to fasten papers together, a staple normally has folded legs that bind and confine the papers between a top wire and the legs. Staple removers are used to ease and simplify the task of unbinding the stack of papers or removing the staple from the substrate.

Staple removers are often complementary to staplers. An edge, surface or other element of the remover extends under the top wire of the staple during or after which the staple is pulled from an object to which it was previously fixed. Two general categories of staple removers are commonly found. One type employs a lever action to slide from one direction under the wire; continued sliding or leveraging then pulls the staple out. Another type uses opposed claws or ends to press under the top wire from opposed sides. This second type may be called a claw type staple remover.

In a leveraging type remover, a net lateral force is created against the staple since the lever is normally forced in from one side only. When used on a lightweight object such as a stack of papers, a user's second hand must hold the paper from sliding or moving laterally. In the claw type remover, the device includes a normal vertical orientation substantially perpendicular to a working surface such as a stack papers. Opposed and substantially equal forces act upon the staple wire to cause minimal net lateral force on the papers or object to which the staple is attached. The claws are generally pivoted to each other at or near a top end of the device, with the jaws at a bottom of the device, and a pressing area for a user's fingers above the jaws, between the jaws and the pivot.

A variation of a leveraging type staple remover has a pliers action whereby the remover is inserted under the staple as with a simple leveraging type, and the tool extends laterally. Squeezing behind a pivot causes the pliers action to spread at the staple. This device remains long and clumsy, and still requires a second hand to stabilize the papers.

The claw type staple remover may be more compact than the leveraging type, but they are inherently inefficient. Jaws of the remover force the staple out by wedging teeth of the jaws under the staple from both sides. The action proceeds via the jaws substantially, entirely sliding against the staple wire through the entire actuation stroke. The action combines sliding with lifting as one action and thus includes substantial friction between the jaws and the staple wire. The excess friction also tends to deform the staple, which may further to add to the force required to remove the staple. Once the jaws are wedged under the staple, the friction and other inefficiencies can limit the ability to fully pull out the staple. A user then must pull the staple directly out of the paper; and such action tends to tear the paper.

Some claw removers may combine sliding and lifting as partially separate operations. But the two functions include substantial overlap and are thus not efficient. Or the functions may be separate, but require distinct types of actions from a user to complete a removing operation.

The deformation and friction from the conventional claws against the staple often cause one staple leg to pull out before the other leg, leaving one leg still hooked in the paper. This requires another step in the removal process where the user must use his or her fingers or a set of pliers to pluck out the staple. The deformation of the staple wire can also cause the staple to get wedged in between the two respective jaws of the remover. This then requires a further operational step to detach the staple from the remover. This final step to separate the staple from the remover can be more difficult than removing the staple from the paper.

It would be desirable to be able to consistently grab and pull a staple from the paper in one, low force squeezing motion using a simple, efficient, compact, and low cost remover device.

SUMMARY OF THE INVENTION

The present invention is primarily directed to the claw type, although the features of the invention may be incorporated into a lever type or combination of types. In a preferred embodiment of the present invention, a staple remover is substantially vertically oriented and operated by squeezing two arms toward each other in a lateral direction from nearly directly above the staple. The present invention remover is primarily discussed in the context of an office appliance where it is normally used to remove a staple that has fastened or attempted to fasten a stack of papers, but other applications are possible. Used as an office appliance, the staple remover normally unfolds and pulls the staple legs through the previously bound paper stack. It is also anticipated that the remover may or instead be used in the context of a tacker device. For example, it may be desired to remove a staple from a wood, cork, or other like substrate. In this further use, the staple is normally pulled directly out from the substrate, with legs not normally requiring unfolding.

According to one embodiment, the staple remover preferably operates through at least three steps. To remove a staple binding a stack of papers, a first step includes moving at least one of two tapered, pointed or extended jaw tips or ends to be located adjacent to a top staple wire. A second step includes moving the jaw points under the wire. A third step includes a first jaw remaining substantially stationary on the paper stack while the opposed second jaw pulls or lifts the top wire directly away from the paper stack. The first jaw provides a reaction surface for the force of pulling by the second jaw. The two jaws directly pull away from each other vertically, with minimal lateral sliding or motion. In a typical exemplary embodiment, there is minimal sliding against the staple wire.

In the second step to move the jaws under the wire, some sliding may occur against the wire if it is required to lift the wire to fit the structure of the jaw tip. However, the net second step travel of a jaw under the wire is just enough to reliably enable the jaw to perform the third lifting step. For example, it may be preferred to extend the jaw tip by up to about one, two, or three wire widths past the wire. Width as defined here is a direction perpendicular to a theoretical plane substantially formed by the top wire and legs of a staple. In this example, a wire of about 0.020 inch width would suggest a second step jaw travel of 0.040", 0.060" or 0.080", or once, twice or triple the width, to extend about 0.020" to 0.060" past the wire. The travel is for each respective jaw, so two moving jaws provide about 0.080" to 0.160" additive travel. In the case that one of the two jaws remains beside the staple, and not under it, the travel for such a jaw is not a primary element of the second step as only one jaw moves under the wire. Optionally, the travel may be greater than three wire widths past the wire if appropriate for a selected application.

By limiting the jaw travel in the second step, an amount of work or effort required from a user is minimized since the subsequent, at least one raising step involves minimal sliding against the wire. In contrast, a typical prior art claw type remover normally operates substantially by means of a lateral sliding motion against the wire. An angled metal edge of the remover jaw wedges the wire away from the paper by sliding against the wire.

The third step includes a user's pressing motion acting on the staple to provide the lifting action. A handle or lever is separately movable from either or any of the jaws. Upon the completion of the second step, the jaws are in a specified position under the staple wire as described above. In the third step, the separately movable handle is moved to lift one of the jaws away from the paper. The handle is linked to the jaws as described in detail below. As a result, a single squeezing motion accomplishes all operating steps. A user need not reposition a hand or take any other distinct action to complete a staple removing cycle.

In normal office use for the present invention staple remover acting on a standard staple, a peak force applied to the remover by a user in the third step is typically less than about 5 lbs., and preferably less than about 3 lbs., to lift the staple away from a substrate, such as a stack of papers. The low effort peak force is a culmination of the present invention structural features. This contrasts with a typical prior art claw remover where a squeezing force of about 10-15 lbs. may be required to pull a staple out of the same stack of papers.

The present invention remover in a preferred embodiment is not substantially larger than a conventional, high-effort claw remover. It is preferably about 2 to 3 inches tall or less, and more preferably less than about 2.5 inches tall, to maintain compactness based on empirical analysis. A maximum preferred grip distance is about 2 inches, which gives ergonomic leverage to users who may possess smaller hands and shorter fingers with lower squeezing strengths.

In the preferred embodiment staple remover, a total motion of a user's fingers toward each other may include the first positioning step, the second grabbing step, and the third removing step. This total motion may be about 0.7 inch to complete a removing cycle. In this example, the first step may include a finger motion of about 0.1 inch to contact the wire, and a second step finger motion of an approximate 0.080 inch for one or both jaws moving under the wire. The third step includes a finger motion of about 0.6 inch as the staple is lifted. As a result, the present invention provides a uniquely efficient structure as disclosed herein while contained within a very compact package.

BRIEF DESCRIPTION OF THE DRAWINGS

FIG. 4 is a cross-sectional view of the staple puller of FIG. 1 in an intermediate position at an end of a second operating step.

DETAILED DESCRIPTION OF THE PREFERRED EMBODIMENTS

Figure 2:
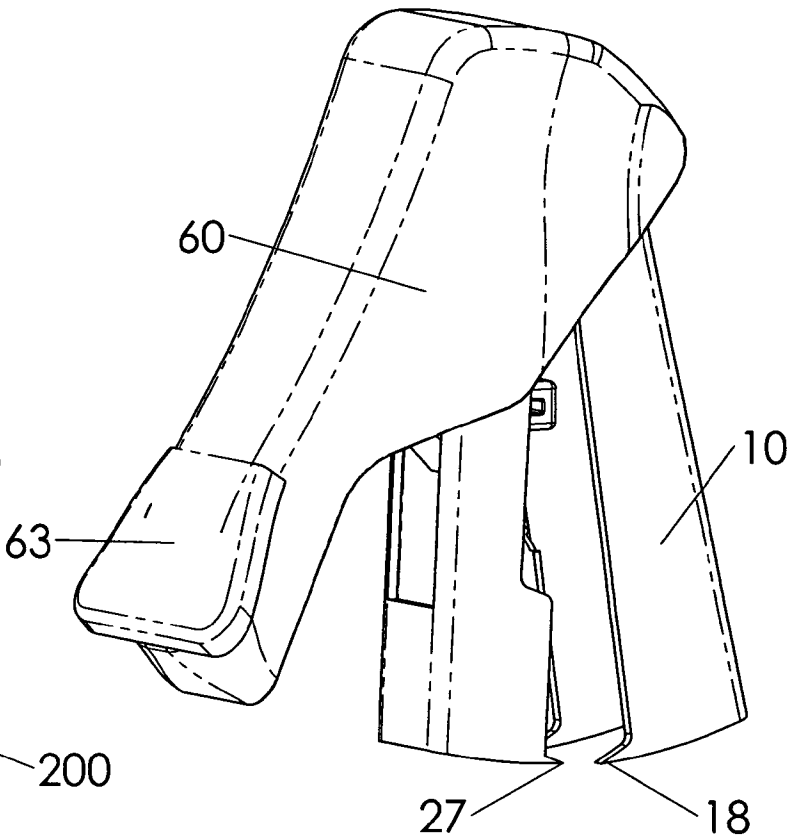
FIG. 2 is a perspective handle side view of the staple remover of FIG. 1.
Figure 1:
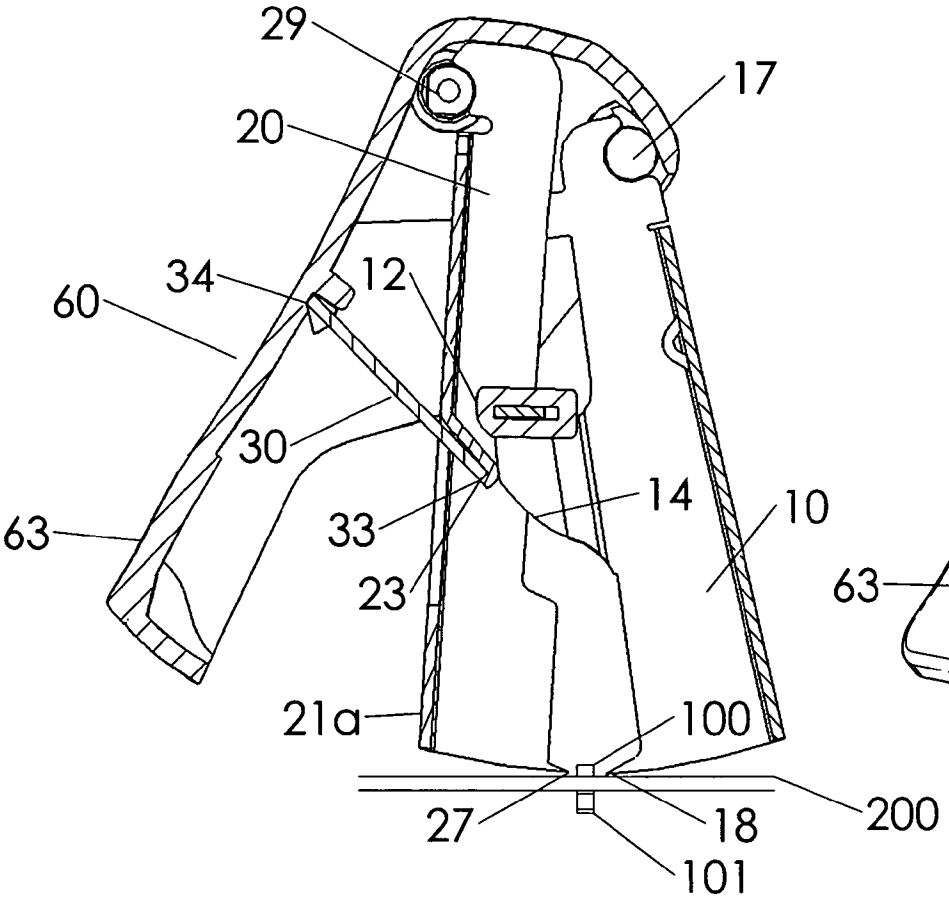
FIG. 1 is a cross-sectional view of a preferred embodiment staple remover in the position before step 1.

FIGS. 1 and 2 show a preferred embodiment of the staple remover of the present invention in a rest or open configuration at the start of a first operational step. Outer jaw 10 is opposed to inner jaw 20. The term "inner" is used for convenient reference only to describe the relationship to the illustrated embodiment where the inner jaw 20 is disposed between handle 60 and outer jaw 10. Various alternative embodiments may include a movable or other pressing element beside outer jaw 10, to the right in FIG. 1. A normal position of the staple remover includes the jaws and handle extending approximately vertically or perpendicular to a horizontal working surface 200, as depicted in FIG. 1. Working surface 200 is typically a stack of papers that have been fastened by metal staple 100 where staple legs 101 are folded behind the paper stack. Working surface 200 may also be a wood or cork bulletin board, or similar substrate where the staple has been tacked into the surface by a stapler or tacker device. Needless to say, the orientation of the working surface 200 may be horizontal, vertical, upside down, sloped, etc.

In the rest configuration, jaw points 18 and 27 are spaced apart. In the operative initial position of the remover, the points 18, 27 are at substantially the same level above surface 200 to each side of staple 100. Outer jaw 10 pivots on handle 60 or a like structure linked to handle 60 about post, pin, or equivalent structure 17. A reset spring (not shown) biases outer jaw 10 away from at least one of inner jaw 20 and handle 60. Pressing on outer jaw 10 at a pressing area of the jaw while the jaw is near the working surface 200 (which biases it to the left in FIG. 1) causes points 18 to move toward points 27 to contact staple 100.

Handle 60 is pivotably or equivalently attached to inner jaw 20 at post, pin or equivalent structure 29. Latch 30 normally holds handle 60 in a fixed position spaced away from inner jaw 20. Latch 30 may be pivotably attached to handle 60 at end 34. De-linkable end 33 rests on catch 23 of inner jaw 20.

To operate, the preferred embodiment staple remover is squeezed at handle 60 and outer jaw 10. In the first step, outer jaw 10 pivots toward inner jaw 20 to close the points 18, 27. Handle 60 remains in the fixed and spaced position away from inner jaw 20. The remover is squeezed until jaw points 18, 27 are adjacent to a top wire of staple 100 as seen in FIG. 4. This may be considered an end for the first operational step.

Figure 3:
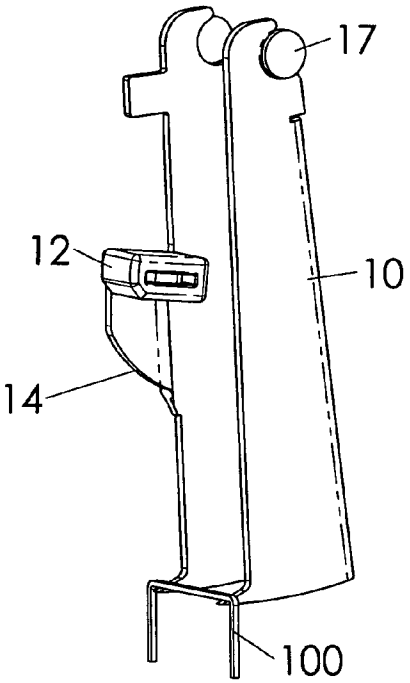
FIG. 3 is a perspective view of a pulling jaw of the staple remover.

In a second operational step, the sharp jaw points 18, 27 slide under the staple top wire. In FIG. 4, a pre-release position is shown corresponding to what may be characterized as the end of the second operational step. As seen in FIGS. 3, 4, rib 14 of outer jaw 10 contacts de-linkable release end 33. Bearing 12 between the jaws limits inward motion of the respective jaws toward each other to define and/or control the relative position of points 18 and 27 under the top wire of staple 100. In FIG. 4, the staple leg is shown straight and unfolded as in a tacker application although it may be folded at this stage for a paper stack application as in FIG. 1. The staple 100 is depicted in a cross-section to allow viewing of the jaw points 18, 27.

Figure 4A:
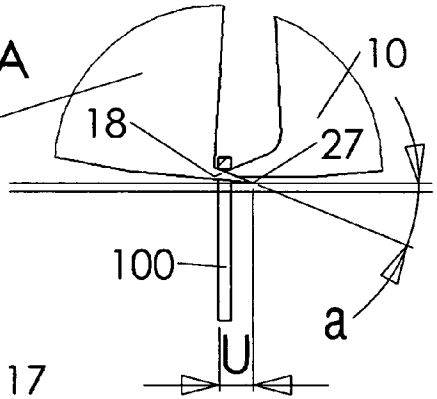
FIG. 4A is a detailed view of the jaw points of FIG. 4.
Figure 6:
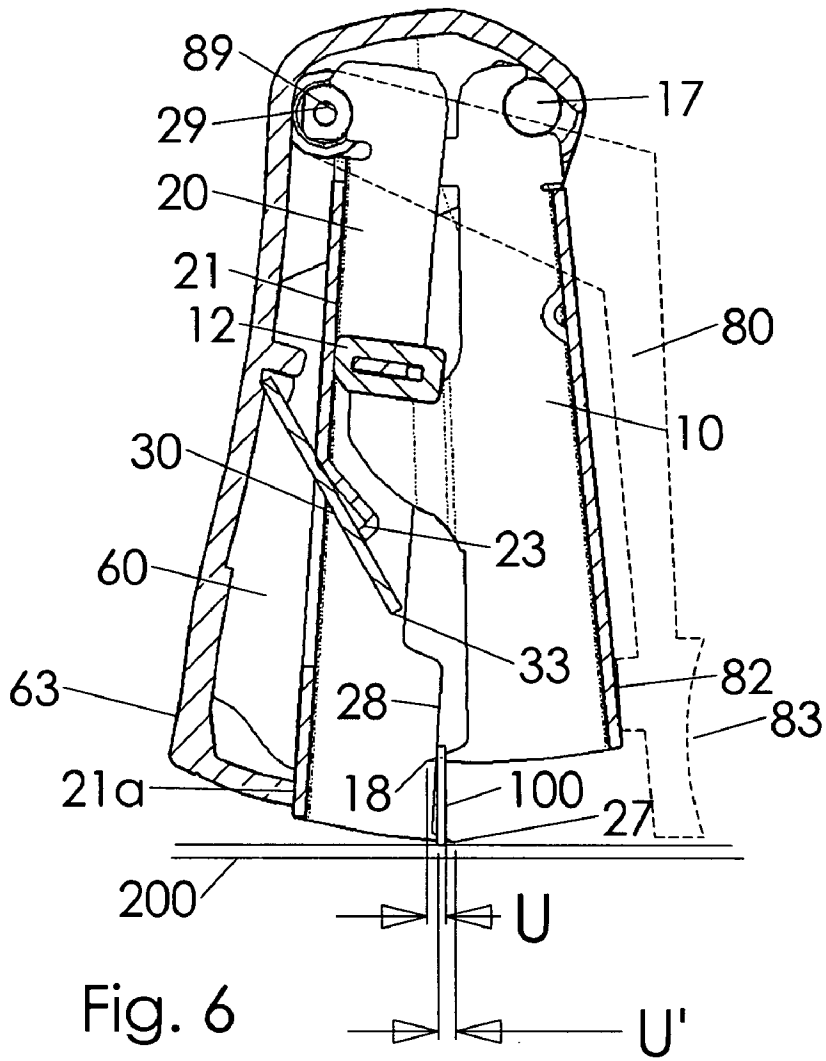
FIG. 6 is a cross-sectional view of the staple remover of FIG. 5, at an end of the third step.

FIG. 4A is a detailed view of the jaw points 18, 27. Dimension U is the distance jaw point 27 extends under staple 100. As discussed above, this distance may range from one wire width to three wire widths or more. In the case of a standard 26-6 type staple, the wire is about 0.020" wide, so jaw 27 may extend preferably from about 0.020" to 0.060" for values of dimension U. The range given here and elsewhere in this disclosure contemplates the values at the stated outside limits and in between those limits. As seen in FIG. 4A, the staple may be off center with respect to points 18 and 27. So for a nominally selected value of U, the actual dimension may vary between uses or between jaws, as depicted in FIG. 6 for dimensions U and U'. As seen in FIG. 6, in the instance that the present invention remover is used with a stack of papers 200, maintaining one pair of points 27 set stationary under the staple wire while another pair of points 18 rises provides minimal stress on the papers, and the staple legs unfold immediately against the stationary inner jaw 20.

Figure 4B:
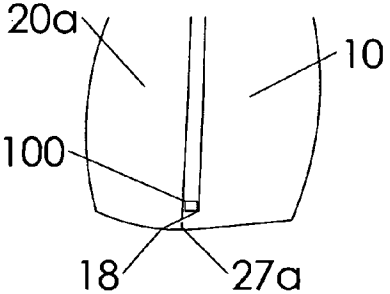
FIG. 4B is a detailed view of alternative embodiment jaws acting on a staple.
Figure 4A:
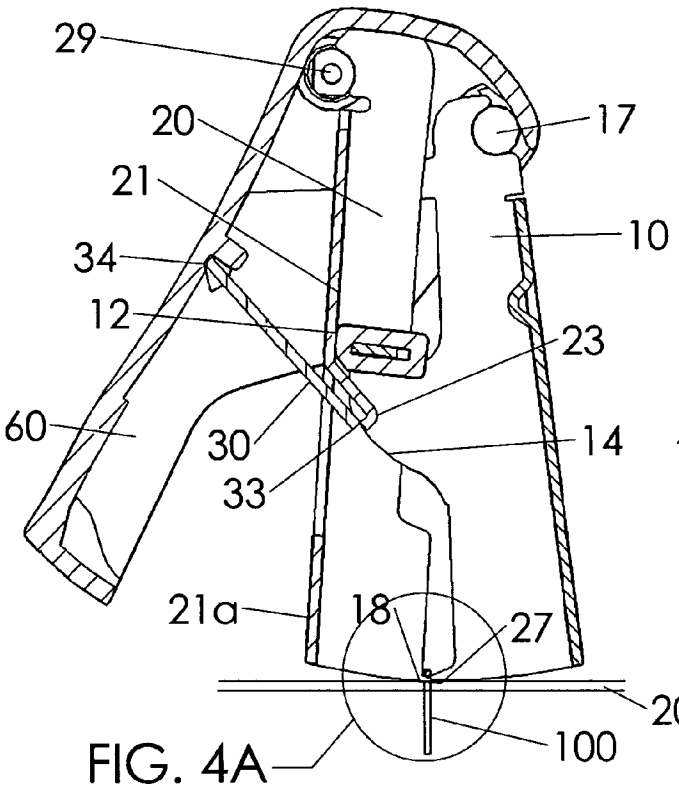

In FIG. 4B, an alternative embodiment is shown. Jaw 10 includes points 18. In this embodiment, jaw 20*a* has a minimal number of points or no points. The substantially vertical face at point or corner 27*a* presses one side of staple 100. Points 18 extend under the wire of staple 100. In this embodiment, dimension U of FIG. 4A applies only or primarily to jaw 10 and points 18.

As seen in FIG. 4, edge of rib 14 presses latch 30 to dislodge or disengage it from catch 23 at the end of the second step. Preferably latch 30 rotates at end 34. At the position of FIG. 4, latch 30 de-links handle 60 from inner jaw 20. The two jaws 10, 20 are held in a substantially constant relative angular or spaced apart position by bearing 12 engaging ceiling 21 after the end of step 2. A slight change to the angle may occur from arcing of pivot 17 about pivot 29.

The de-linking process occurs through a small range of motion of outer jaw 10 toward inner jaw 20. Specifically, the de-linking normally commences at a position of the jaw points, of at least one jaw point, just after contact with the staple wire. This corresponds to just after completion of step 1, as step 2 has begun. The de-linking is complete at an end of step 2, where the at least one set of jaw points 18, 21 is in the position of dimension U, U' as shown in FIGS. 4A, 4B, 6. As discussed above, dimension U may range up to four staple widths, with all intermediate dimensions possible and larger dimensions optional. Dimension U' shows both jaw points extending under the wire with U and U' not necessarily identical. According to the above discussion, the de-linking action occurs preferably within a lateral step 2, where jaw travel range is of less than about 0.040" (i.e., one wire width past for one jaw) to 0.16" for two respective jaws moving toward each other a preferred maximum distance during step 2.

From FIG. 4, continued squeezing or pressing includes a third operational step to raise the staple away from the substrate. A transition between the second and third steps includes the de-linking discussed above. Therefore, there may be an overlap between steps 2 and 3. The jaw point slides under the wire as de-linking occurs, and continues to slide under the wire to a limit of dimension U as the jaw begins to lift the wire. In the preferred embodiment, this transition and de-linking action are brief and well defined to limit the overlap of slide and lifting action, preferably substantially less than a maximum dimension U or combined dimension U, U'. For example, the de-linking action may occur through about a total relative jaw motion of about one to two wire widths. In this manner, a required user force through a full operation of the remover is minimized; combined under-sliding and lifting occur only briefly. Such combined action if prolonged causes high effort and inefficient operation as seen in prior art claw removers.

In the exemplary embodiment, rib 14 forces latch 30 to de-link by sliding off from catch 23. De-linking end 33 is normally stable on catch 23. Optionally, catch 23 may be angled to normally bias release end 33 to be unstable and slide off of the catch. Then rib 14 is configured (not shown) to normally hold the end 33 engaged to catch 23 and not to slide off or disengage. At a predetermined position of step 2, rib 14 disengages from end 33 and latch 30 is free to de-link. For example, an edge of rib 14 may normally, and optionally slidably, contact end 33. At a release position, a recess on rib 14 aligns with end 33 whereby end 33 moves into the recess of rib 14. This "passive release" design reduces any peak force associated with the illustrated "active release" structure. The absence of a rib at the recess causes a reduced force at the release position, in contrast with a sudden presence of a rib contact in the active release. However, if an angle of contact is properly selected, the illustrated active release design can maintain a reasonable peak release action force.

Alternative embodiments for a release or de-linkable member are contemplated. For example, latch 30 may take a form of sliding block, roller, or equivalent structure (not shown). The block may be slidably or movably fitted to ceiling 21*a* of jaw 20. The block selectively engages an inward extending rib (not shown) of handle 60. At the de-linking position of the jaws, rib 14 moves the block out of engagement with the rib of handle 60 and handle 60 closes toward the block.

Handle 60 moves toward inner jaw 20, preferably by pivoting about pivot or post 29 of inner jaw 20. The staple remover approaches the end of the third step in the configuration shown in FIGS. 5 and 6. Handle 60 includes a link, or equivalent structure, spanning a distance between post 29 and pivot 17. Pivoting of handle 60 about pivot or post 29 raises jaw 10 by pulling at pivot 17 or equivalently linked portion of jaw 10. A distance between pressing area 63 and post 29 may define a handle length; such an effective length may be less than a distance to a distal end of the handle. The handle length is preferably about three times the distance between post 29 and 17, with a preferred range of about 2 to 4 times. Via empirical observations, this is the effective leverage available to raise staple 100 in the third step.

Other alternative embodiments and equivalent structures (not shown) to provide such leverage for the third operational step may be provided such as rollers, wheels, and/or low friction cams. For these structures, the distances or leverages described above culminate in an unexpectedly great mechanical advantage. For example, through empirical observations, if the linkage is a roller and cam system, then pressing area 63 similarly moves toward the jaws in a ratio of preferably about three times the distance that jaw 10 moves upward even as there may be no explicit levers.

Jaw 10 includes a slight arcing motion about pivot 29, but primarily translates longitudinally near the jaw point along guide edge 28 of jaw 20, as bearing 12 slides along ceiling 21. Jaw point 27 remains pressing against working surface 200 as jaw point 18 rises. The staple wire is pulled away from working surface 200 to remove the staple. In the case of a staple folded behind a paper stack, stationary jaw point 27 is above the folded legs to provide a reliable reaction surface to hold down and support the papers as the staple leg unfolds against the backside of the paper stack.

Alternatively, the staple remover includes a structure whereby jaw point 18 with jaw 10 may advantageously remain stationary while jaw point 27 with jaw 20 rises. In contrast, a moving jaw or end of the prior art sliding removers are less predicable in holding the paper down. The conventional removers are thus more likely to tear the paper.

Figure 5:
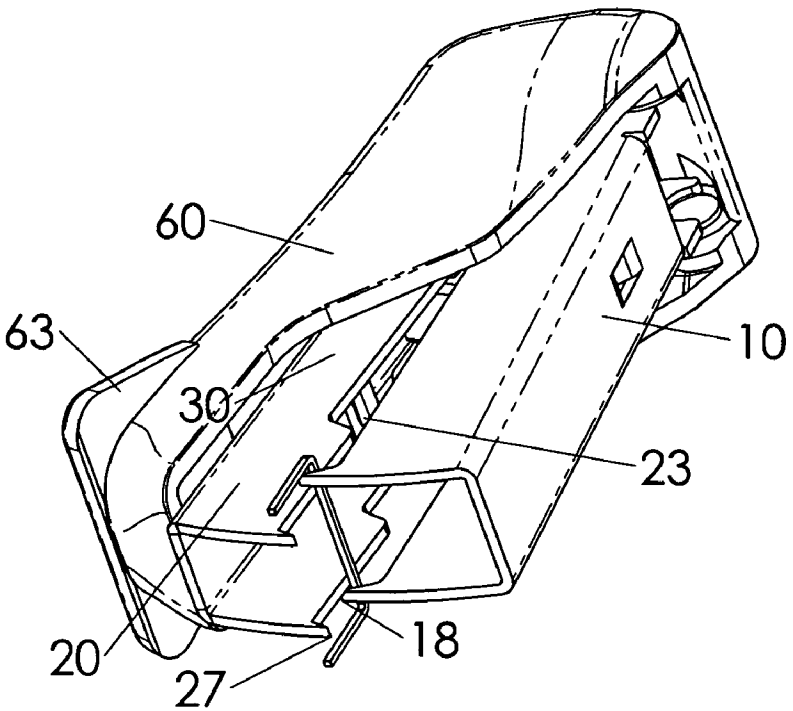
FIG. 5 is a bottom perspective view of the staple remover raised at an end of a second step.

The action of step 3 of FIGS. 5 and 6 includes very minimal sliding. There may be a light positioning force acting on the staple 100 as it follows guide edge 28. This light force is caused by a bias on the staple from the angle of the top of jaw point 18 as discussed below. Optionally, this force can be reduced further from its minimal magnitude by allowing the staple 100 to slide slightly downward along jaw point 18 as the staple rises. Edge 28 would angle away slightly, about 1°-5°, relative to the upward direction of motion of jaw point 18. Then a light cam action from the angled top of jaw point 18 would slightly bias the staple to slide down jaw point 18 as the staple rises against slightly angled edge 28. For example, the staple may slide about one staple wire width toward the point tip as it is raised. The staple may move slightly on the point area for other reasons as it rises, such as lateral urging of the remover. Any sliding on an edge of the points for these other reasons is incidental; the useful pulling motion on the staple is most directly effected during the third operational step through upward translation of jaw 10.

In the preferred embodiment, the jaw points slide a minimal distance under the staple wire. Also the angle of the top edge, labeled "a" in FIG. 4A, is minimal. These structures provide subtle advantages and unexpected results. In typical prior art claw removers, this angle may exceed 30° where it contacts the staple in normal use, and often changes gradually to near 90° past that location, in relation to work surface 200 as the remover is normally oriented in use. This angled cam engagement provides a substantial element of the raising action in the typical prior art remover. On the other hand, in the preferred embodiment, the angle is preferably less than about 20°, and further preferably less than about 15°. By using a small jaw travel under the staple for at least the lifting jaw —outer jaw 10 —it is practical to maintain a small edge angle in a sturdy, short point extension. In contrast, a small angle combined with a long travel under the staple typical of the prior art may require a long narrow extension of the point. Such a shape is not practical in normal stamping or like manufacturing operations, and is prone to deformation in use. The combination of small edge angle and minimal travel for the preferred embodiment staple remover is an unexpected solution for lifting the staple.

The relative pivoting between the jaws and handle 60 creates a near zero friction cam action to pull the staple upward. Virtually no sliding occurs through the third pulling step. This contrasts with a conventional claw remover wherein the primary cam action is caused by direct sliding and wedging of a metal edge against a staple wire. The puller aspect of the preferred embodiment staple remover further contrasts with a leveraging type staple remover, wherein the preferred embodiment is compact laterally and does not require a second hand to position, or to hold papers or other working surface.

The operation of the staple remover includes preferably three distinct steps, positioning about the staple, sliding minimally under the staple, and raising of the staple with near zero sliding within the remover device. The operation occurs substantially exclusively with one continuous squeezing action on the remover. No secondary pulling or other actions are required. Handle 60 and outer jaw 10, or optional pressing lever 80 (FIG. 6) provide an intuitive interface. These functions are provided in a compact structure; the pressing areas are below the pivot locations of the handle and jaw, between the working surface and the respective pivots. This contrasts with a pliers type design.

In the exemplary embodiment, each jaw includes two separate points. And points 27 are shown to fit within a channel of jaw 10 at points 18. Optionally, at least one jaw may include a spade or knife-like edge. For example, points 27 may alternatively be connected (into the page in FIG. 1) to form a single continuous edge. This edge then extends under the staple during step 2. Furthermore, points 18 may alternatively fit within a channel formed by jaw 20.

Fingers pressing outer jaw 10 normally move slightly upward as the inner jaw rises. This extra action may be slightly inefficient since the fingers are not exclusively moving to squeeze the remover. In an alternative embodiment, however, pressing lever 80 (FIG. 6 in phantom) may be attached to inner jaw 20 at pivot 89 near jaw pivot 29. The pressing lever includes pressing area 83 substantially opposed to handle pressing area 63. As outer jaw 80 rises, pressing lever 80 remains at a substantially fixed distance relative to working surface 200. Outer jaw 10 slides against bearing 82. Bearing 82 and the corresponding face of inner jaw 10 are smooth so any added friction is minimal. Bearing 12 operates similarly; such sliding contact contrasts with a metal edge acting on a staple wire at a high angle typical in the prior art claw removers, where friction losses are substantial on the order of up to half of the input effort. By contrast, in the preferred embodiment staple remover, substantially more than half of a user's input is used to lift the staple.

In a reset action, one or more reset springs (not shown) bias handle 60 and outer jaw 10 respectively away from inner jaw 20. Outer jaw 10 moves down to its rest position of FIG. 1. A further reset spring or portion thereof biases latch 30 to reengage catch 23, in the rest position shown in FIG. 1.

From the foregoing detailed description, it should be evident that there are a number of changes, adaptations, and modifications of the present invention that come within the province of those skilled in the art. Thus, it is intended that all such variations not departing from the spirit of the invention be considered as within the scope thereof except as limited solely by the following claims.

The invention claimed is:

1. A staple remover device, comprising:

first and second respective opposed elongated jaws extending from a lower end of the remover toward an upper end of the remover, the jaws pivoted to the remover at the upper end, the remover being in a substantially perpendicular orientation above a work surface, and the first jaw moves toward the second jaw;

a handle extends downward from the upper end and is pivotably attached to the first jaw at an upper end of the jaw, the handle being normally operationally fixed by a latch to the first jaw such that the handle is spaced from the first jaw by the latch, and at a pre-determined position of the first jaw to the second jaw the handle suddenly de-links from the first jaw wherein the de-linked handle is movable toward the first jaw;

wherein the second jaw extends alongside the first jaw, the handle is pivoted to the second jaw whereby the handle includes a link between the first jaw and the second jaw; and moving the handle in relation to the first jaw causes the second jaw to rise.

2. The staple remover of claim 1, wherein at least one jaw includes a jaw point at a lower distal end of the jaw, the handle undergoes a cycle of de-linking from the first jaw through a corresponding motion of the jaw point toward the opposed jaw of between about 0.040" to about 0.16".

3. The staple remover of claim 2, wherein the corresponding motion defines a distance of about 0.080".

4. The staple remover of claim 1, wherein the handle includes a pressing area between the lower end of the remover and the upper end of the remover, the pressing area is spaced by a handle length from the pivotal attachment of the handle, a link distance of the link of the handle is about two to four times shorter than the handle length.

5. The staple remover of claim 4, wherein the link distance of the handle is about three times shorter than the handle length.

6. The staple remover of claim 1, wherein the handle, at a pressing area, includes a mechanical advantage upon the second jaw wherein the handle pressing area moves toward at least one jaw a distance or ratio of about two to four times a distance that the second jaw moves upward.

7. The staple remover of claim 6, wherein the mechanical advantage comprises a ratio of about three times.

8. The staple remover of claim 1, wherein the first and second jaws extend downward from upper locations in a substantially parallel relationship, and the handle extends alongside the jaws wherein the first jaw is positioned between the second jaw and the handle.

9. A staple remover device, comprising:

first and second respective opposed elongated jaws extending from a lower end of the remover toward an upper end of the remover, the jaws pivoted to the remover at the upper end, a handle extending alongside the jaws whereby the first jaw is positioned between the second jaw and the handle;

at a pre-determined position of the first jaw to the second jaw, the handle suddenly de-links from the first jaw wherein the handle moves toward the first jaw; and moving the handle in relation to the first jaw causes the second jaw to rise in relation to the first jaw.

10. The staple remover of claim 9, wherein at least one jaw includes a jaw point at a lower distal end of the jaw, as the handle undergoes a cycle of de-linking from the first jaw the jaw point moves toward the opposed jaw a distance of between about 0.040" to about 0.16".

11. The staple remover of claim 10, wherein the distance is about 0.080".

12. The staple remover of claim 9, wherein the handle is pivotably attached to the first jaw at an upper end of the jaw, the handle is normally spaced from the first jaw by a latch, and the de-linked handle is movable toward the first jaw.

13. The staple remover of claim 12, wherein a release rib of the second jaw contacts the latch at the pre-determined position, the release rib causing the latch to move to de-link the first jaw from the handle.

14. The staple remover of claim 13, wherein the release rib presses the latch, and under a bias from the release rib, the latch rotates to a de-linking position.

15. The staple remover of claim 13, wherein the release rib normally engages the latch to hold the latch in a linked position, and at the pre-determined position the release rib disengages the latch to allow the latch to move a de-linking position.

16. A staple remover device, comprising:

first and second respective opposed elongated jaws extending from a lower end of the remover toward an upper end of the remover, the jaws pivoted to the remover at the upper end, the remover being in a substantially perpendicular orientation above a horizontal work surface, and the first jaw moves toward the second jaw;

a handle extends along the remover, the handle being normally operationally fixed to a jaw by a link including a latch, and at a pre-determined position of the first jaw to the second jaw, a release rib of at least one jaw causes the latch to suddenly de-link the handle from the jaw; and wherein the de-linked handle moves in a relation to the jaw whereby moving the handle in relation to the jaw causes the other jaw to rise.

17. The staple remover of claim 16, wherein the release rib presses the latch, and under a bias from the release rib, the latch rotates to a de-linking position.

18. The staple remover of claim 16, wherein the release rib normally engages the latch to hold the latch in a linked position, and at a pre-determined position the release rib disengages the latch to allow the latch to move to a de-linking position.

* * * * *